United States Patent [19]

Schaffner

[11] Patent Number: 5,036,749

[45] Date of Patent: Aug. 6, 1991

[54] TRIGGER SAFETY FOR A FIREARM

[75] Inventor: Kurt Schaffner, Worblaufen, Switzerland

[73] Assignee: Schweizerische Eidenossenschaft Eidgenossische . . ., Berne, Switzerland

[21] Appl. No.: 489,225

[22] Filed: Mar. 6, 1990

[30] Foreign Application Priority Data

Mar. 10, 1989 [EP] European Pat. Off. ..... 89810192.8

[51] Int. Cl.[5] ..... F41A 17/46; F41A 19/33

[52] U.S. Cl. ..... 89/148; 89/198

[58] Field of Search ..... 42/70.06; 89/142, 148, 89/198

[56] References Cited

U.S. PATENT DOCUMENTS 1,249,576 12/1917 Wesson ..... 42/70.06
1,451,443 4/1923 Fowler ..... 89/149
1,803,349 5/1931 Pfeiffer ..... 89/136
2,050,539 8/1936 Moore ..... 89/132
2,374,378 4/1945 Rice ..... 42/70.06

FOREIGN PATENT DOCUMENTS 347528 3/1905 France .
14263 4/1897 Switzerland .

*Primary Examiner*—Stephen C. Bentley
*Attorney, Agent, or Firm*—Marks Murase & White

[57] ABSTRACT

A guiding tube is mounted on the buffer cylinder at the rear end of an automatic firearm. On this guiding tube, a safety ring is fitted in non-rotatable but axially displaceable manner. In a forward operating position the safety ring prevents depressing the trigger, and thus, any firing. In a backward operating position of the safety ring the trigger may be freely actuated. This safety arrangement is simple in design and operation, and it may easily be mounted on existing weapons.

7 Claims, 2 Drawing Sheets

TRIGGER SAFETY FOR A FIREARM

The present invention relates to a trigger safety on a firearm, particularly a heavy machine gun, having a pivotable trigger and a rotatable firing selection guiding tube. A gun of this kind is e.g. Swiss Army MG 64 calibre 12.7 mm (M2(HB,QCB)0.5O cal-type machine gun). At the rear, this gun has a trigger and a tumbler release located between two handles. Single shots may be fired by operating the trigger, while repetitive firing is obtained by simultaneous operation of the trigger and the tumbler release. On a buffer cylinder projecting rearwardly from the trigger casing, a guiding tube having a hold-down spring is rotatably mounted. By rotating this guiding tube, its hold-down spring may be swiveled over the tumbler release, and the latter is thus permanently held in a repetitive firing position. The trigger can be freely operated in any position of the guiding tube, respectively of the hold-down spring mounted thereon. Consequently, no safety is provided, which leads to single shots or even series of shots being occasionally fired if the trigger is accidentally operated.

It is the object of the present invention to create a trigger safety for such weapons. This object is attained in that a locking member axially displaceable between a firing position and a safety position is provided which in its safety position blocks the pivot movement of the trigger. It is thus made possible to lock the weapon and to avoid any unwanted firing.

Further details and advantages of the trigger safety according to the invention will be apparent from the following description of an embodiment.

Figure 2:
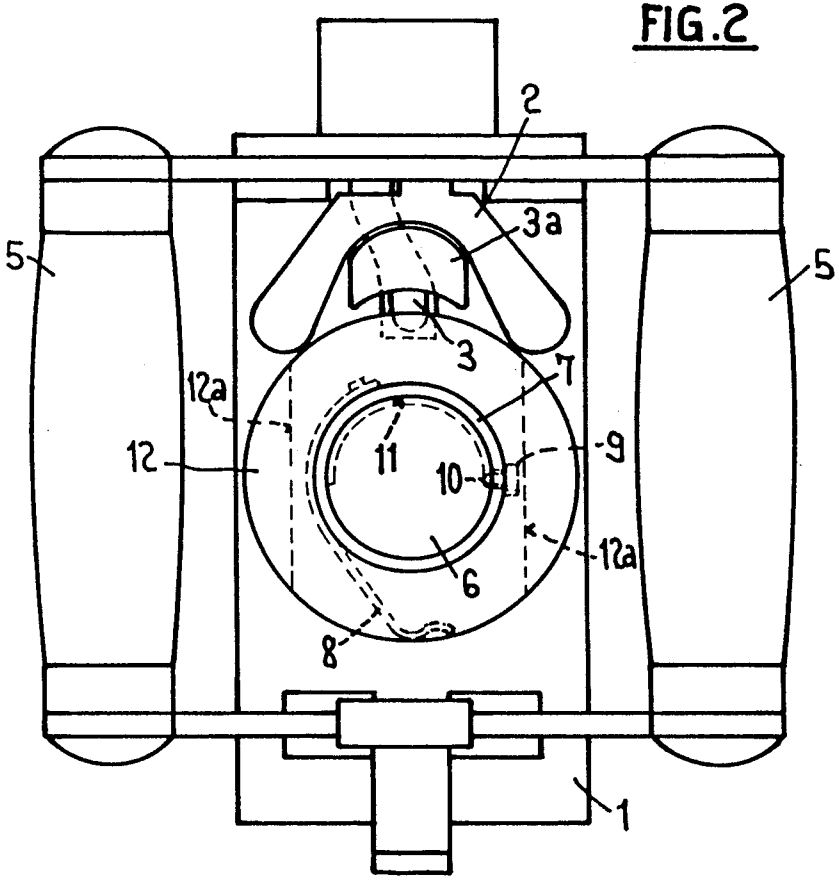
FIG. 2 shows a back view of the weapon and the trigger safety.
Figure 1:
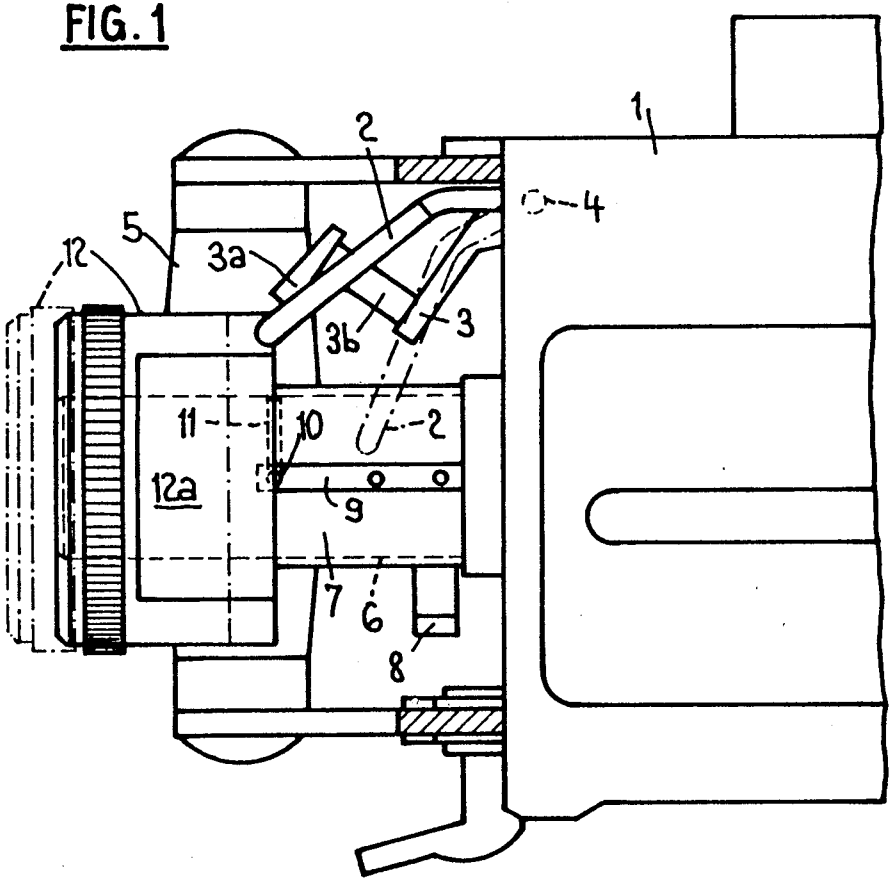
FIG. 1 shows a side view of the rear end of the weapon and the trigger safety.
Figure 4:
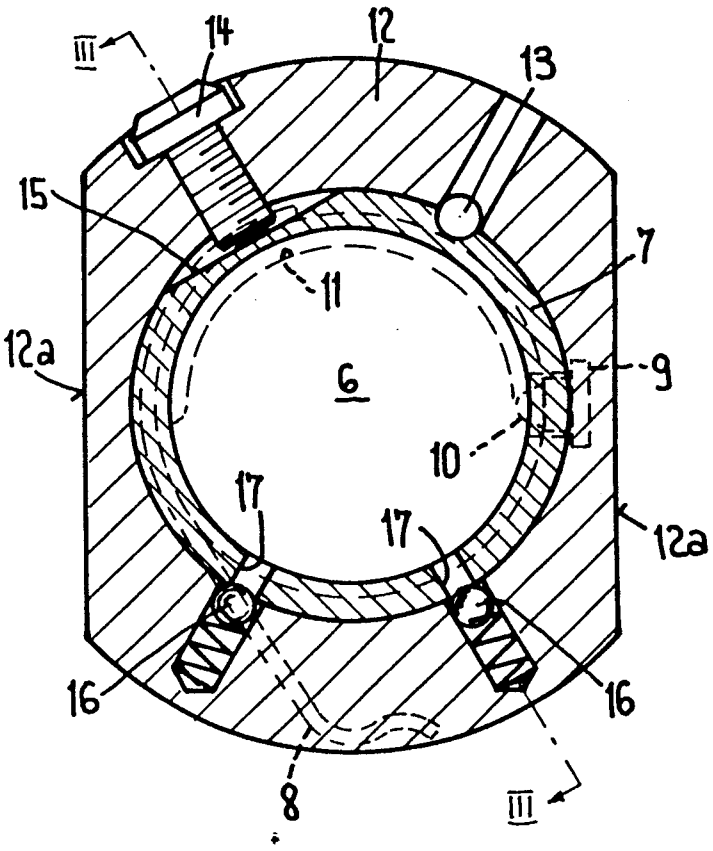
FIG. 4 shows a cross-section through the trigger safety according to line IV—IV of FIG. 3.
Figure 3:
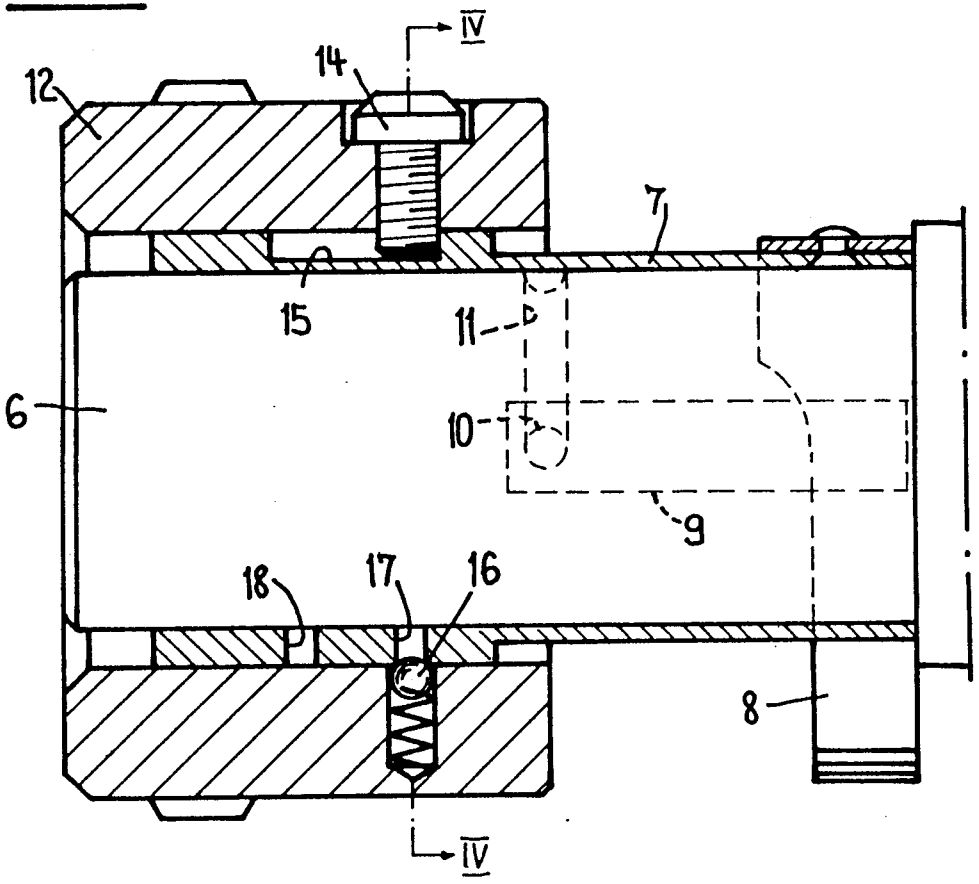
FIG. 3 shows a longitudinal section through the trigger safety according to line III—III of FIG. 4.

FIGS. 1 and 2 show the rear end of the weapon and the trigger casing 1, in which a fork-shaped trigger 2 and a tumbler release 3 having an actuating plate 3*a* are pivotably mounted on a common axle 4. Parts 2 and 3 are located between two handles 5. When the weapon is held by the handles, trigger 2 and tumbler release 3 may be independently pivoted downwards from an inactive position as represented in FIGS. 1 and 2. When only trigger 2 is depressed, a single shot is fired upon each downward movement. Simultaneous depressing of tumbler release 3 allows repetitive firing as long as trigger 2 is pressed down. A firing selection guiding tube 7 with a hold-down spring 8 riveted to its front end is rotatably mounted on buffer cylinder 6 projecting backwards from trigger casing 1. A positioning pin 10 under pressure of spring 9, which is riveted to the guiding tube, engages with a positioning groove 11 extending over about 180° of the cirumference of buffer cylinder 6 through a radial bore of guiding tube 7. When positioning pin 10 is in the position represented in the drawings, the free end of hold-down spring 8 is located at the bottom, i.e. diametrically opposite trigger 2 and tumbler release 3. However, guiding tube 7 and hold-down spring 8 may be rotated counterclockwise by about 180° from the represented position, whereby hold-down spring S can be brought into the area of tumbler release 3. When the tumbler release is depressed, hold-down spring may be swiveled over intermediate portion 3*b* of the tumbler release, and the latter is thus held in its lowered repetitive firing position. Accordingly, repetitive firing is effected each time the trigger is actuated.

The above-described constructive elements correspond to those of the existing, above-mentioned machine gun. It follows from the previous description that no safety was provided, i.e. accidental actuation of trigger 2 and/or tumbler release 3 with consequent unintentional firing may occur at any time. According to the invention, a safety is provided in order to obviate this danger. To this end, a safety ring 12 having flat milled surfaces 12*a* is mounted on guiding tube 7. In the shown position of guiding tube 7, surfaces 12*a* extend vertically, i.e. about parallel to an axial vertical plane passing near the free end of hold-down spring 8. After the above-mentioned rotation of guiding tube 7, hold-down spring 8, and safety ring 12, which is non-rotatingly fixed thereto, by about 180° in order to keep tumbler release 3 depressed, surfaces 12*a* extend vertically again, i.e. parallel to handles 5 in such a manner that the safety ring does not hinder holding the weapon by handles 5. As mentioned above, the safety ring 12 is non-rotatingly connected to guiding tube 7 by means of a key 13. Safety ring 12 is however axially displaceable on guiding tube 7, namely over a distance which is limited by a stop screw 14 engaging with a milled surface 15 of guiding tube 7. The axial end positions of the safety ring 12 are additionally determined by spring-loaded locking balls 16 which are adapted to drop into front locking bores 17 or rear locking bores 18. In the drawing, safety ring 12 is shown in its forward end position in which it blocks the pivot movement of trigger 2 and thus prevents any depression of the latter for firing a single shot or a series of shots. Accordingly, the weapon is locked in this position of safety ring 12. For unlocking, the safety ring 12 may be pulled backwards without considerable effort into an end position as illustrated by dotted lines in FIG. 1 and determined by locking balls 16 dropping into locking bores 18, in which position the pivot movement of trigger 2 is no longer blocked. The weapon can thus be operated normally.

The spring-loaded positioning pin 10 engaging with annular groove 11 of buffer cylinder 6 serves not only the purpose of limiting the rotational movement of about 180° of guide tube 7 and safety ring 12 mounted thereon, but also that of securing those parts on buffer cylinder 6. If the safety ring together with guiding tube 7 is retracted sufficiently forcefully, positioning pin 10 may be disengaged from groove 11 while overcoming the pressure of spring 9, and the safety ring may be drawn from the buffer cylinder together with the guiding tube. Consequently, the corresponding guiding tube 7 of an existing weapon without a safety ring 12 may be simply drawn off from buffer cylinder 6 and replaced with the above-described assembly having a safety ring 12. Existing weapons may thus be retrofitted without any problems.

What is claimed is:

1. A trigger safety on a firearm having a pivotable trigger and a rotatable firing selection guiding tube, wherein a locking member axially displaceable between a firing position and a safety position is provided which, in its safety position, blocks the pivot movement of said trigger; and wherein said locking member is mounted axially displaceably on a guiding tube which is rotatably attached to a part of said weapon.

2. A safety according to claim 1, wherein on said guiding tube, a spring-loaded positioning pin is provided which is intended for engagement with an annular groove of limited length on said part of said weapon and thus serves the purpose of axially positioning and limiting the rotational movement of said guiding tube.

3. A safety according to claim 1, wherein said two positions of said locking member are determined by axial stops and drop-in members.

4. A safety according to claim 1, wherein there is a rotational lock between said guiding tube and said locking member.

5. A trigger safety on a firearm having a pivotable trigger and a rotatable firing selection guiding tube, wherein a locking member axially displaceable between a firing position and a safety position is provided which, in its safety position, blocks the pivot movement of said trigger, wherein said locking member has the shape of a safety ring having opposing flat surfaces.

6. A safety according to claim 5, wherein a hold-down spring for a tumbler release of said weapon is attached to said guiding tube, the engaging portion of said spring being approximately located in an axial plane that is parallel to said flat surfaces of said safety ring and being rotatable by about 180° from an effective position into an inactive position.

7. A safety according to claim 5 or 6, wherein said safety ring is located between handles of said weapon.

* * * * *

UNITED STATES PATENT AND TRADEMARK OFFICE

CERTIFICATE OF CORRECTION

PATENT NO. : 5,036,749

DATED : August 6, 1991

INVENTOR(S) : SCHAFFNER

It is certified that error appears in the above—identified patent and that said Letters Patent is hereby corrected as shown below:

Title Page:
Assignee, Item [73], "Schweizerische Eidenossenschaft

Eidgenossische . . ." should be -- Schweizerische

Eidgenossenschaft Eidgenossische Waffenfabrik Bern --.

Signed and Sealed this

Fourth Day of May, 1993

*Attest:*

Michael K. Kirk

MICHAEL K. KIRK

*Attesting Officer*

*Acting Commissioner of Patents and Trademarks*